United States Patent [19]

Takayasu

[11] Patent Number: 4,625,688

[45] Date of Patent: Dec. 2, 1986

[54] FUEL SUPPLYING SYSTEM FOR INTERNAL COMBUSTION ENGINE

[75] Inventor: Hidekazu Takayasu, Hamamatsu, Japan

[73] Assignee: Sanshin Kogyo Kabushiki Kaisha, Shizuoka, Japan

[21] Appl. No.: 741,005

[22] Filed: Jun. 4, 1985

[30] Foreign Application Priority Data

Jun. 5, 1984 [JP] Japan ..... 59-113823

[51] Int. Cl.[4] ..... F02B 33/04

[52] U.S. Cl. ..... 123/73 B; 123/73 C

[58] Field of Search ..... 123/73 B, 73 A, 73 PP, 123/73 R, 73 C, 311, 317, 318

[56] References Cited

U.S. PATENT DOCUMENTS

| | | | |
|---|---|---|---|
| 2,055,026 | 9/1936 | Cook | 123/73 B |
| 2,959,164 | 11/1960 | Janeway et al. | 123/73 A |
| 3,687,118 | 8/1972 | Nomura | 123/73 B |
| 4,066,050 | 1/1978 | Ford-Dunn | 123/73 PP |
| 4,075,985 | 2/1978 | Iwai | 123/73 B |
| 4,194,470 | 3/1980 | Magner | 123/73 A |
| 4,248,185 | 2/1981 | Jaulmes | 123/73 A |
| 4,462,346 | 7/1984 | Haman et al. . | |

FOREIGN PATENT DOCUMENTS

| | | | |
|---|---|---|---|
| 47-30645 | 9/1972 | Japan . | |
| 48-12410 | 2/1973 | Japan . | |
| 51-158921 | 12/1976 | Japan . | |
| 52-124531 | 10/1977 | Japan . | |
| 52-45844 | 11/1977 | Japan . | |
| 56-66435 | 6/1981 | Japan . | |
| 2115485 | 9/1983 | United Kingdom | 123/73 B |

*Primary Examiner*—Craig R. Feinberg
*Assistant Examiner*—David A. Okonsky
*Attorney, Agent, or Firm*—Ernest A. Beutler

[57] ABSTRACT

A fuel supplying system for a two-cycle crankcase compression internal combustion engine. A first charge forming device supplies a fuel/air charge to the crankcase and a second charge forming device supplies a fuel/air charge to the scavenge passage that connects the crankcase with the combustion chamber. A check valve is positioned in the scavenge passage so as to prevent reverse flow and the discharge of the second charge forming device is related to the check valve so as to improve the fuel delivery.

20 Claims, 3 Drawing Figures

FUEL SUPPLYING SYSTEM FOR INTERNAL COMBUSTION ENGINE

BACKGROUND OF THE INVENTION

This invention relates to a fuel supplying system for internal combustion engines and more particularly to an improved fuel supplying system for two-cycle engines that improves fuel economy, cold running and cold starting.

As is noted in copending application Ser. No. 673,908 still pending, entitled "Fuel Supplying System For Internal Combustion Engine", filed Nov. 21, 1984 in the name of Yoshihiro Sakurai, and assigned to the assignee of this application, two-cycle engines present certain problems in connection with fuel condensation, particularly when operating at low temperatures and until the engine has warmed up. The fuel/air mixture, which is normally introduced into the crankcase, must travel a long distance from the crankcase through the transfer and/or scavenge passages to the combustion chamber before it is fired. Because of the long distance of travel, when the engine is at a low operating temperature, there is a likelihood of fuel condensation. Therefore, in order to compensate for this condensation, it has been the practice to provide additional enrichment fuel which considerably reduces the fuel economy and which oftentimes does not overcome the problem.

In accordance with the arrangement disclosed in that application, a separate charge former is provided that supplies a fuel/air mixture into the transfer passage and thus minimizes the length of travel and reduces the condensation problems. Although that arrangement is particularly advantageous, it itself has certain disadvantages and areas that could be improved. For example, there is a flow in both directions through the scavenge passage in that type of engine since the pressure in the combustion chamber at times exceeds the pressure in the crankcase and when the scavenge passage is still open. Under this condition, the fuel/air mixture supplied by the additional charge former will be returned to the crankcase where it can condense under low temperatures. In addition, the fuel must then flow back through the scavenge passage to the combustion chamber thus further increasing the likelihood of condensation.

It is also known that the initial intake charge from the scavenge passage is used to purge the residual gases from the combustion chamber and at least a portion of the initial intake charge flows out the exhaust port to insure good scavenging. With a device of the type shown in the aforenoted copending application, the initial charge of fuel and air delivered to the combustion chamber through the scavenge passage has large amounts of fuel and this fuel will be wasted if it is discharged through the exhaust port. In addition, under some running conditions, the velocity of the charge through the scavenge passage may not be sufficient so as to draw the required amount of fuel from the charge former provided in this passage.

It is, therefore, a principal object of this invention to provide an improved fuel supplying system for internal combustion engines.

It is a further object of this invention to provide a fuel supply system for internal combustion engines that will eliminate the likelihood of fuel condensation.

It is a yet further object of this invention to provide an improved fuel supply system for internal combustion engines that insures against the discharge of fuel through the exhaust port during the initial scavenging cycle.

It is a yet further object of this invention to provide a fuel supply system for internal combustion engines wherein the fuel is supplied in proximity to a high velocity air flow so as to insure good vaporization and fuel distribution.

SUMMARY OF THE INVENTION

A first feature of this invention is adapted to be embodied in a charge forming arrangement for an internal combustion engine comprising an induction passage for delivering a charge to the combustion chamber of the engine, and check valve means for precluding flow through the induction passage until the pressure thereacross exceeds a predetermined value. A fuel discharge nozzle is provided for discharging fuel into the induction passage between the combustion chamber and the check valve.

Another feature of this invention is adapted to be embodied in a fuel supply system for a two-cycle crankcase compression internal combustion engine that comprises a cylinder, a piston reciprocating in the cylinder, a crankcase and transfer means for transferring a charge compressed in the crankcase to the area in the cylinder above the piston for at least a portion of the stroke of the piston. First charge forming means are provided for delivering a fuel/air charge to the crankcase and second charge forming means including a discharge nozzle opening into the transfer means is provided for delivering a fuel/air charge directly to the transfer means independently of the crankcase. In accordance with this feature of the invention, check valve means are provided in the transfer means between the crankcase and the discharge nozzle of the second charge forming means.

DETAILED DESCRIPTION OF THE PREFERRED EMBODIMENT

Figure 1:
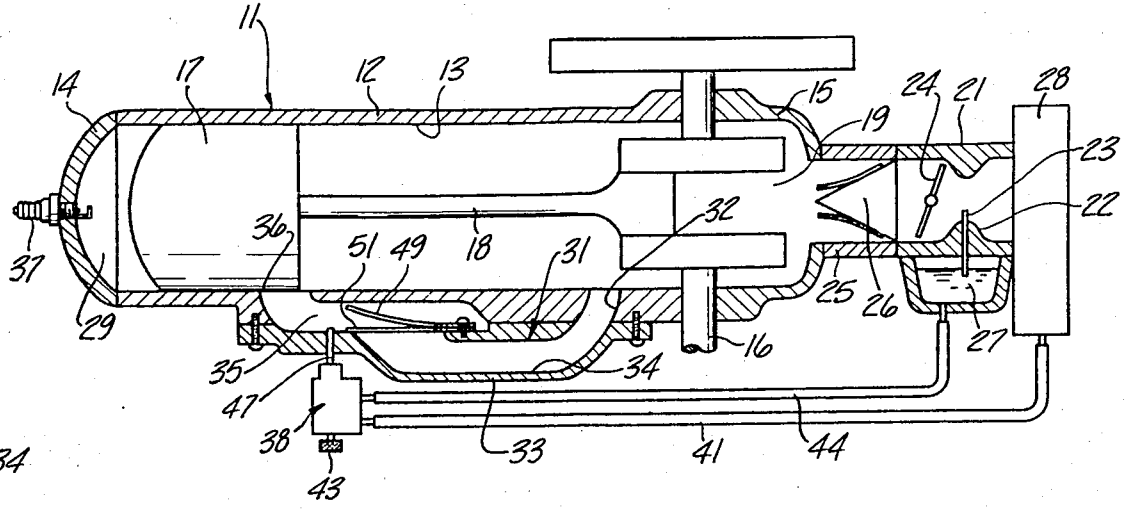
FIG. 1 is a partially schematic cross-sectional view taken through the single cylinder of an outboard motor embodying a crankcase compression, two-cycle engine constructed in accordance with an embodiment of the invention.
Figure 3:
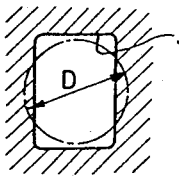
FIG. 3 is a cross-sectional view taken along the line 3—3 of FIG. 2.

Referring first to FIG. 1, an internal combustion engine constructed in accordance with an embodiment of the invention is identified generally by the reference numeral 11. In the illustrated embodiment, the engine 11 is particularly adapted for use as the power plant of an outboard motor. It is to be understood, however, that the invention may be susceptible of use in other applications, such as are common with two-cycle engines. Also, the invention is described in conjunction with a single cylinder engine but it is believed to be apparent to those skilled in the art from the following description how the invention can be applied to engines of multiple engine types or engines having varying cylinder configurations.

The engine 11 includes a cylinder block 12 that defines a cylinder bore 13 which extends in a generally horizontal direction in view of the application of the engine 11 to an outboard motor. One end of the cylinder bore 13 is closed by a cylinder head 14 while the opposite end is closed by a crankcase 15 in which a crankshaft 16 is supported for rotation about a generally vertically extending axis. A piston 17 is supported for reciprocation within the cylinder bore 13 and is connected to the crankshaft 16 by means of a connecting rod 18.

A crankcase chamber 19 is provided by the crankcase 15 and in the area of the cylinder bore 12 below the piston 17. A first charge forming device, in the form of a carburetor 21, is provided with a venturi section 22 in which a discharge nozzle 23 is provided. A throttle valve 24 controls the flow through the venturi section 22 into an intake manifold 25 that delivers this charge to the crankcase chamber 19. A reed-type check valve assembly 26 is provided in the manifold 25 so as to prevent reverse flow. Fuel is delivered to the nozzle 22 from a fuel bowl 27 in a known manner. An air inlet device 28 is affixed to the air horn of the carburetor 21 and silences the induction air.

As is well known, during the upward movement of the piston 17 within the cylinder bore 13, there will be a reduced pressure exerted in the crankcase 19 that causes a fuel/air charge to be drawn into it past the reed-type check valve 26. As the piston 17 begins its downward movement, this charge is compressed and then is transferred to a combustion chamber 29 formed above the piston 17 and in the cylinder head 14 through one or more transfer or scavenge passageways, indicated generally by the reference numeral 31.

The scavenge passageway includes an inlet port 32 that is formed at the lower end of the cylinder bore 13 and which is selectively opened and closed by the reciprocating movement of the piston 17. The port 32 extends through the wall of the cylinder block 12 and is closed by a casing piece 33 that is affixed to the side of the cylinder block and in which an extension 34 of the scavenge passageway 31 is formed. The extension 34 communicates with a further scavenge passageway 35 that is formed in part by the cylinder block 12 and by the casing 33. This passageway 35 terminates in a scavenge port 36 which is selectively opened and closed by the reciprocation of the piston 17 so as to transfer the charge into the combustion chamber 29 for firing by means of a spark plug 37 that is supported in the cylinder head assembly 14 in a known manner.

Figure 2:
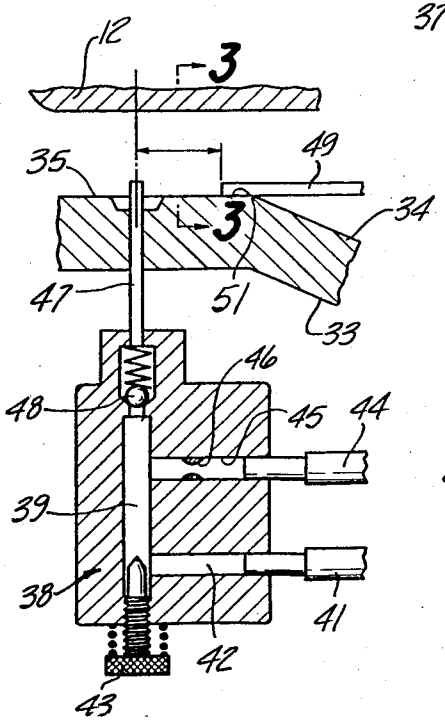
FIG. 2 is an enlarged cross-sectional view showing the construction of the charge former associated with the transfer or scavenge passage.

A second charge forming device, indicated generally by the reference numeral 38, is provided for supplying a fuel/air charge to the scavenge passage 31. The second charge forming device 38 has a construction which is best shown in FIG. 2 and which is comprised of a body portion in which a mixing chamber 39 is formed. The mixing chamber 39 receives air from the air inlet device 28 via a conduit 41 and internal passage 42. An air control valve 43 is carried by the body portion and is adapted to selectively control the amount of flow delivered by the charge forming device 39 by adjusting the air flow.

Fuel is delivered to the mixing chamber 39 from the fuel bowl 27 of the carburetor 21 by means of a conduit 44. The conduit 44 communicates with a passageway 45 in which a metering jet 46 is provided so as to control the amount of fuel delivered to the mixing chamber 39. From the mixing chamber 39, fuel is discharged into the scavenge passage 31 and specifically its portion 35 by means of an elongated nozzle 47 that receives the fuel/air mixture from the mixing chamber 39 via a check valve 48. The location of discharge of the nozzle 47 into the scavenge passage 31 is particularly important and will now be described.

When the piston 17 is moving upwardly and before the scavenge port 36 has been closed, there will be a time when the pressure at the port 36 is greater than the pressure in the inlet port 32. The check valve 48 of the charge former 38 will prevent any reverse flow into the mixing passage 39 from the scavenge passage 31. However, with conventional constructions, the fuel/air mixture may be blown back through the scavenge passage 31 into the crankcase 19 where there is a likelihood of condensation. such reverse flow is precluded by means of a reed-type check valve 49 that is mounted to a side of a casing 33 where the passage 34 communicates with the passage 35. The reed-type check valve is lightly biased to closing position with a seat 51 that is formed at the termination of these passages. When the pressure in the crankcase chamber 19 is greater than the pressure in the passage 35, the reed-type check valve 49 will open and permit flow through the scavenge passage 31.

The tip of the nozzle 47 is spaced downstream from the closed position of the tip of the reed-type check valve 49 by a distance "L" which is chosen to be quite small and is less than the mean effective diameter "D" of the passageway 35. As a result, the initial charge of air that passes through the reed-type valve 49 when it opens will be directed at the tip of the nozzle 47 and a high velocity will occur when flow is established so as to provide good vaporization. This is important to the effective operation of the device.

During running, and as has been previously noted, the carburetor 21 will supply a fuel/air mixture to the crankcase chamber 19. When the piston 17 begins its downward movement, the reed-type check valve 49 will be held closed until a predetermined pressure differential exists as is set by the bias of the check valve 49. When this pressure is exceeded, the check valve 49 will open due to its flexibility and flow may occur from the scavenge passage portion 34 into the portion 35. During this initial movement, the gas velocity will be relatively slow and there will not be any fuel drawn from the nozzle 47. This is important since the initial charge is used primarily for scavenging purposes and will flow out of the exhaust port (not shown). As a result, this operation improves fuel efficiency without sacrificing in scavenging efficiency.

As the piston 17 continues its downward movement, there will be sufficient force created to cause the air to flow at a high velocity past the tip of the reed-type check valve 49 and across the tip of the nozzle 47 to insure good vaporization for cold running and cold starting enrichment. The amount of such enrichment may be controlled by manipulating the knob 43. In addition, no reverse flow will be permitted when the piston 17 begins its upward movement, for the reasons as aforedescribed.

From the foregoing description, it is believed that it will be apparent to those skilled in the art that this device is extremely effective in providing good enrichment without the likelihood of fuel condensation and furthermore good scavenging without wasting fuel. Although an embodiment of the invention has been illustrated and described, various changes and modifications may be made without departing fro the spirit and scope of the invention, as defined by the appended claims.

I claim:

1. A charge forming arrangement for an internal combustion engine comprising an induction passage for delivering a charge to a combustion chamber of said engine, reed-type check valve for precluding flow through said induction passage until pressure thereacross exceeds a predetermined value, a fuel bowl adapted to contain a source of fuel at substantive atmospheric pressure, and a fuel discharge nozzle for delivering fuel into said induction passage between said combustion chamber and said check valve means, and conduit means for delivering fuel from said fuel bowl to said fuel discharge nozzle for discharge of fuel therefrom in response to a pressure difference between said fuel bowl and an outlet of said discharge nozzle wherein said fuel discharge nozzle is positioned contiguous to a periphery of a tip of said reed-type valve.

2. A charge forming arrangement as set forth in claim 1 wherein the tip of the fuel discharge nozzle is positioned at a lesser distance from the tip of the reed-type valve than an effective diameter of the induction passage.

3. A charge forming arrangement as set forth in claim 1 wherein the reed-type valve is operative to reduce the flow through the induction passage upon initial opening of the reed-type valve.

4. A charge forming arrangement as set forth in claim 1 wherein the engine is a crankcase compression internal combustion engine operating on a two-stroke cycle and the induction passage is a passage that connects the crankcase with the combustion chamber.

5. A charge forming arrangement as set forth in claim 4 wherein the induction passage is a scavenge passage.

6. A charge forming arrangement as set forth in claim 5 wherein the tip of the fuel discharge nozzle is positioned at a lesser distance from the tip of the reed-type valve than an effective diameter of the induction passage.

7. A charge forming arrangement as set forth in claim 5 wherein the reed-type valve is operative to reduce the flow through the induction passage upon initial opening of the reed-type valve.

8. A charge forming arrangement as set forth in claim 7 wherein the induction passage is a scavenge passage.

9. A charge forming arrangement as set forth in claim 4 wherein the fuel discharge nozzle is effective to provide cold starting enrichment.

10. A charge forming arrangement as set forth in claim 9 wherein the induction passage is a scavenge passage.

11. A charge forming arrangement as set forth in claim 10 wherein the tip of the fuel discharge nozzle is positioned at a lesser distance from the tip of the reed-type valve than an effective diameter of the induction passage.

12. A charge forming arrangement as set forth in claim 10 wherein the reed-type valve is operative to reduce the flow through the induction passage upon initial opening of the reed-type valve.

13. A charge forming arrangement as set forth in claim 12 wherein the induction passage is a scavenge passage.

14. In a fuel supply system for a two-cycle crankcase compression internal combustion engine comprising a cylinder, a piston reciprocating in said cylinder, a crankcase, and transfer means for transferring a charge compressed in said crankcase to the area in said cylinder above said piston for at least a portion of the stroke of said piston, a first carburetor for delivering a fuel/air charge to said crankcase and a second carburetor including a discharge nozzle opening into said transfer means for delivering a fuel/air charge directly to said transfer means independently of said crankcase, the improvement comprising check valve means in said transfer means between said crankcase and said discharge nozzle of said second charge forming means.

15. In a fuel supply system as set forth in claim 14 wherein the second carburetor comprises a mixing chamber, a fuel supply for delivering fuel to said mixing chamber, an air supply for delivering air to said mixing chamber, and means for controlling the flow through at least one of said supplies for controlling the fuel/air mixture.

16. In a fuel supply system as set forth in claim 14 wherein the carburetors have a common air inlet comprising an air intake device providing at least silencing of the intake air.

17. In a fuel supply system as set forth in claim 14 wherein the check valve means comprises a reed-type valve.

18. In a fuel supply system as set forth in claim 17 wherein the fuel discharge nozzle is positioned contiguous to a periphery of a tip of said reed-type valve.

19. In a fuel supply system as set forth in claim 18 wherein the tip of the fuel discharge nozzle is positioned at a lesser distance from the tip of the reed-type valve than an effective diameter of the induction passage.

20. In a fuel supply system as set forth in claim 18 wherein the reed-type valve is operative to reduce the flow through the induction passage upon initial opening of the reed-type valve.

* * * * *